United States Patent [19]

Oku et al.

[11] Patent Number: 4,701,668

[45] Date of Patent: Oct. 20, 1987

[54] CYLINDRICAL IMAGE PICKUP TUBE HAVING ELECTROSTATIC DEFLECTION ELECTRODES FORMED OF STRAIGHT LINE PATTERN YOKES

[75] Inventors: Kentaro Oku, Kokubunji; Masakazu Fukushima, Tokyo; Hitomi Suzuki, Akishima; Masanori Maruyama, Kokubunji, all of Japan

[73] Assignees: Hitachi, Ltd.; Hitachi Denshi Kabushiki Kaisha, both of Tokyo, Japan

[21] Appl. No.: 867,155

[22] Filed: May 27, 1986

[30] Foreign Application Priority Data

May 27, 1985 [JP] Japan ..... 60-112018

[51] Int. Cl.[4] ..... H01J 29/70

[52] U.S. Cl. ..... 315/17; 313/432; 315/410

[58] Field of Search ..... 315/17, 410; 313/432, 313/435, 439, 450

[56] References Cited

U.S. PATENT DOCUMENTS

| | | | |
|---|---|---|---|
| 2,681,426 | 6/1954 | Schlesinger | 313/432 |
| 3,319,110 | 5/1967 | Schlesinger | 315/17 |
| 3,796,910 | 3/1974 | Ritz, Jr. | 315/17 |

*Primary Examiner*—Theodore M. Blum

*Attorney, Agent, or Firm*—Antonelli, Terry & Wands

[57] ABSTRACT

A magnetic focusing and electrostatic deflecting image pickup tube comprises electrostatic deflection electrodes each constituted by a straight arrow pattern yoke composed of straight line segments arrayed in a linear zigzag pattern. The pattern yoke has a twist angle set at a value not greater than 105°. An average value of angles formed by each upper apex and two lower apices adjacent to the upper apex of the zigzag pattern yoke with reference to the axis of the tube lies within a range of 116° to 127°.

13 Claims, 20 Drawing Figures

CYLINDRICAL IMAGE PICKUP TUBE HAVING ELECTROSTATIC DEFLECTION ELECTRODES FORMED OF STRAIGHT LINE PATTERN YOKES

BACKGROUND OF THE INVENTION

The present invention generally relates to an image pickup tube employed in a television camera or the like, and more particularly to a structure of electrostatic deflecting electrodes for a magnetic focusing and electrostatic deflecting image pickup tube (hereinafter referred to as MS image pickup tube).

In the heretofore proposed MS image pickup tube, an electron beam produced therein is focused by a magnetic coil disposed around a tubular glass envelope or glass tube, while the electron beam is deflected by two pairs of electrostatic deflecting electrodes, i.e. horizontal and vertical deflecting electrodes, formed on the inner surface of the glass tube. FIG. 1 of the accompanying drawings shows a hitherto known MS image pickup tube in a sectional view. Disposed within a glass tube 1 at one end thereof is an electron gun 2 which is composed of a cathode 21, a first grid 22, a second grid 23 and a beam disc 24 having a limiting aperture formed therein. The electron gun 2 emits an electron beam 3. Disposed within the glass tube 1 at the other end are photoconductive target 4 scanned by the electron beam 3 and a mesh electrode 5. Formed on the inner surface of the glass tube 1 are electrostatic deflection electrodes 6 which generate deflection electric fields for causing the target 4 to be scanned by the electron beam 3 in both horizontal and vertical directions. A focusing coil 7 is disposed externally around the glass tube 1 to generate a focusing magnetic field for focusing the electron beam 3 directed onto the opposing surface of the target 4. A cylindrical electrode 8 is interposed between the mesh electrode 5 and the deflection electrodes 6. The mesh electrode 5 and the cylindrical electrode 8 have an equal potential applied thereto. An electrostatic lens is formed under the influence of potential difference between the cylindrical electrode 8 and the deflecting electrodes 6. This electrostatic lens is referred to as the collimating lens which is effective for eliminating radial landing error of the electron beam 6 deflected by the deflection electrodes 6. The mesh electrode 5 serves to generate a decelerating electric field between the target 4 and the mesh electrode 5 for the purpose of allowing the lowvelocity scanning by the electron beam.

The deflection electrodes 6 are formed through vacuum evaporation of an electrically conductive material on the inner surface of the glass tube 1 and by dividing the electrically conductive layer into four discrete electrodes, each of which has a zigzag pattern and is separated from one another by using a laser beam or the like. The deflection electrodes 6 thus formed are referred to as the pattern yoke. FIG. 2A is a developed view of the pattern yokes 6 as viewed interiorly of the glass tube. Such zig-zag configuration of the pattern yoke is disclosed in U.S. Pat. No. 2,830,228 to Schlesinger i.e., edge portions of the deflection electrodes have sinusoidal curve, and called the curved arrow pattern yoke. FIG. 2B shows the pattern yokes 6 as viewed from the electron gun 2 within the glass tube 1, wherein the thickness of the electrodes is omitted from illustration. Referring to FIG. 2A, a line $B_1B_2$ interconnecting the upper apices M of a zigzag pattern yoke is in the form of a helix extending from one end to the other end of the pattern yoke, revolving about the longitudinal axis of the glass tube. Referring to FIG. 2B, the angle of rotation of the helix, i.e. the central angle $<B_1OB_2$ formed between the points $B_1$ and $B_2$ at which the helix intersects opposite ends of the pattern yoke, respectively, is referred to as twist angle which will be represented by $\omega$. In the case of the illustrated pattern yoke array, the twist angle $\omega$ is 180°. In FIG. 2A, the twist angle is taken along the ordinate with reference to a line $A_1$–$A_2$. The pattern yoke twisted at the twist angle 90 degrees is disclosed in U.S. Pat. No. 3,666,985 to Schlesinger. The pitch of the zigzag pattern yoke from one upper apex to the succeeding one is represented by L, and the number of pitch repetition is represented by n. Then, the length of the pattern yoke is given by nL. Of the pattern yokes, electrodes denoted by H+and H−are, horizontal deflection electrodes to which voltages $+V_H/2$ and $-V_H/2$ superposed on bias voltage $E_{C3}$, respectively, are applied for forming a horizontal deflecting electric field. The electrodes denoted by V+and V−are vertical deflection electrodes to which voltages $+V_V/2$ and $-V_V/2$ superposed on bias voltage $E_{C3}$, respectively, are applied for generating a vertical deflecting electric field.

In connection with the MS image pickup tube of the structure described above, it is taught in U.S. Pat. application Ser. No. 668,844 (field on Nov. 6, 1984) that the twist angle of the pattern yoke should preferably be about 30° in order to enhance remarkably the uniformity of resolution.

Further, in the MS image pickup tube of the aforementioned type, the voltage applied to the mesh electrode can be correspondingly increased by increasing the twist angle. Increasing in the voltage of the mesh electrode in turn reduces the beam bending. With the phrase "beam bending", such a phenomenon is to be understood in which the path of electron is bent toward a bright portion of the target 4 projected with an optical image and which brings about raster distortion near a bright portion of the target as well as degradation of the resolution.

Accordingly, in order to enhance the uniformity of resolution and reduce the beam bending, it is desirable that the twisted pattern yokes be employed.

In the foregoing, structure and operation of the hitherto known MS image pickup tube has been described. Next, problems which the MS image pickup tube of the structure described above will be mentioned below.

FIG. 3 of the accompanying drawings is a developed view of a portion of the pattern yokes in the zigzag array which corresponds to two pitches. It will be seen that gaps $\Delta$ are formed between the adjacent electrodes in the circumferential direction for the purpose of interelectrode insulation.

In the curved arrow pattern yoke illustrated in FIG. 3, in which the segments of the zigzag shaped deflection electrodes have sinusoidal shaped curves, the electrodes are configured such that a very sharp angle is formed at every upper apex of the zigzag profile and that the space between the adjacent deflection electrodes is much narrowed in the vicinity of the upper apex M when compared with the space at a location B. As a consequence, intensity of the electric field is increased in the vicinity of the upper apex, involving the danger that electric discharge may result in partially damaging damage partially or even eventually breaking some deflection electrodes. This in turn means that the uniformity of the deflecting electric field is injured with the raster distortion becoming correspondingly greater, resulting in lowering of the production yield of the image pickup tube.

SUMMARY OF THE INVENTION

It is an object of the present invention to facilitate the fabrication of the pattern yokes employed in the MS image pickup tube and increase the production yield of the image pickup tube.

According to an aspect of the present invention, it is proposed that the deflection electrodes are formed of straight arrow pattern yokes, respectively, each of which is realized in a continuous zigzag and interleaved array of straight line segments, wherein the twist angle of the pattern yoke of the linear zigzag configuration is selected to be not greater than 105°, while the average value of angles $<MON_1$ and $<MON_2$ (referred to as zigzag angle) formed, respectively, by a given upper appex M and two lower apices $N_1$ and $N_2$ located adjacent to the upper apex M with reference to the tube axis O is set at a value within a range of 116° to 127°.

According to the invention, characteristics equivalent to those of the hitherto known curved arrow pattern yoke can be obtained. Besides, the electric discharge possibly occurring between the individual deflection electrodes can be suppressed to a minimum, whereby the production yield of the MS image pickup tube can be significantly increased. In the case of the curved arrow pattern yoke, the corresponding average zigzag angle formed by the upper apex and the lower apices is 180°. In contrast, the zigzag angle is about 120° in the case of the straight arrow pattern yoke according to the invention. By virtue of this, the length of each line segment extending from the upper apex to the lower apex or from the lower apex to the upper apex can be decreased. As a consequence, the time required for forming the pattern yokes according to the invention by using a laser beam or the like can be reduced to about two thirds of the time taken for the formation of the hitherto known yoke pattern, leading to reduction in the manufacturing cost of the pattern yokes.

These and other objects and many of the attendant advantages of the present invention will be readily appreciated as the same becomes better understood by reference to the following detailed description when considered in connection with the accompanying drawings.

DESCRIPTION OF THE PREFERRED EMBODIMENTS

Now, the present invention will be described in detail in conjunction with exemplary embodiments thereof.

Figure 1:
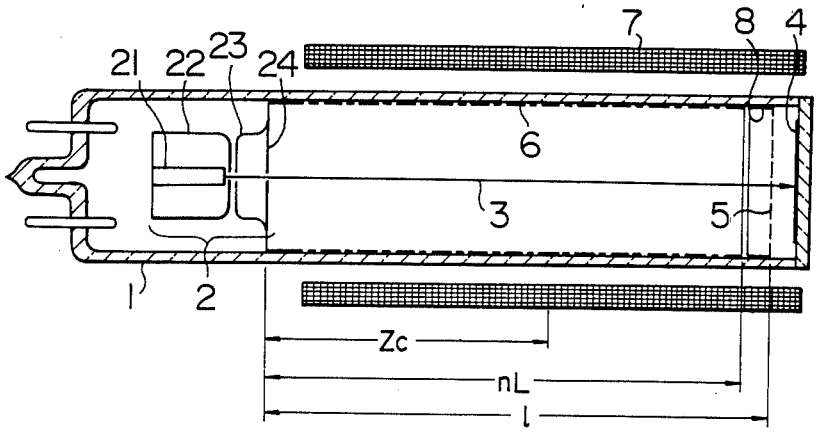
FIG. 1 is a schematic sectional view of a MS image pickup tube.
Figure 2A:
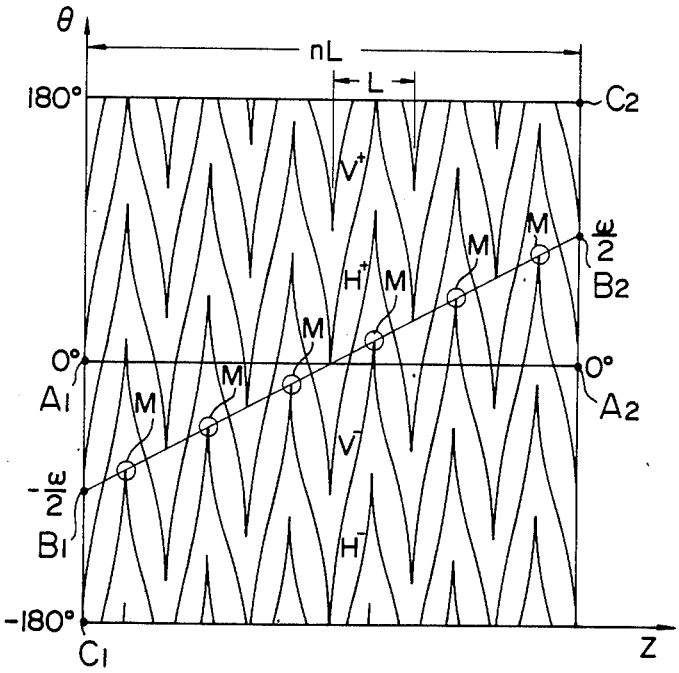
FIG. 2A PRIOR ART
FIG. 2A is a developed view showing the twisted curved arrow pattern yoke as viewed interiorly of the image pickup tube.
Figure 2B:
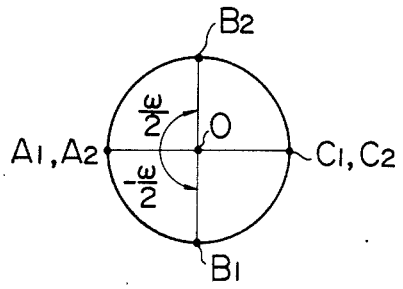
FIG. 2B PRIOR ART
FIG. 2B is a view of the twisted curved arrow pattern yoke as seen from the side of the electron gun.
Figure 3:
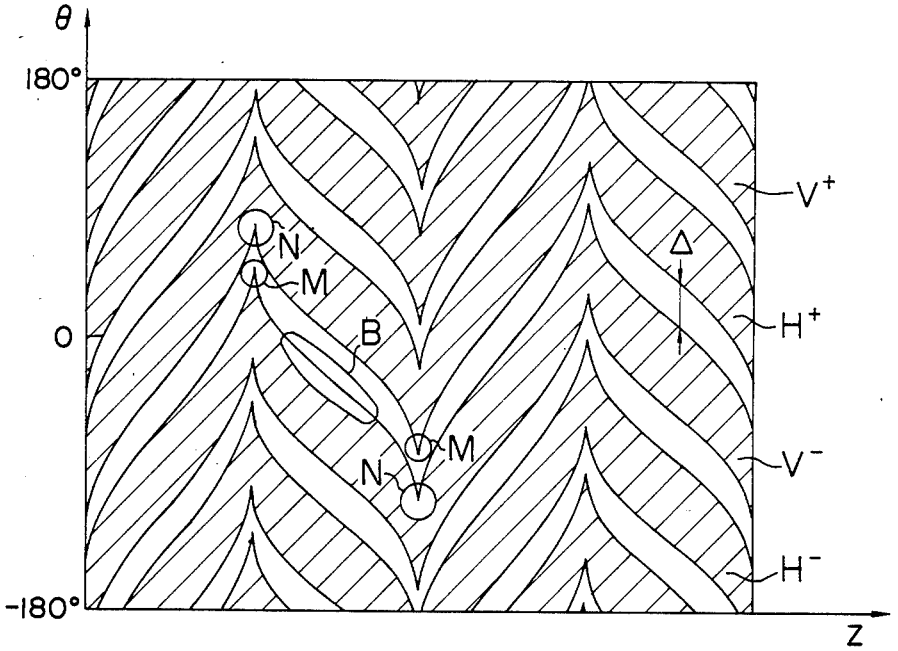
FIG. 3 PRIOR ART
FIG. 3 is a developed view of a portion of the curved arrow pattern yoke corresponding to two pitches.
Figure 4:
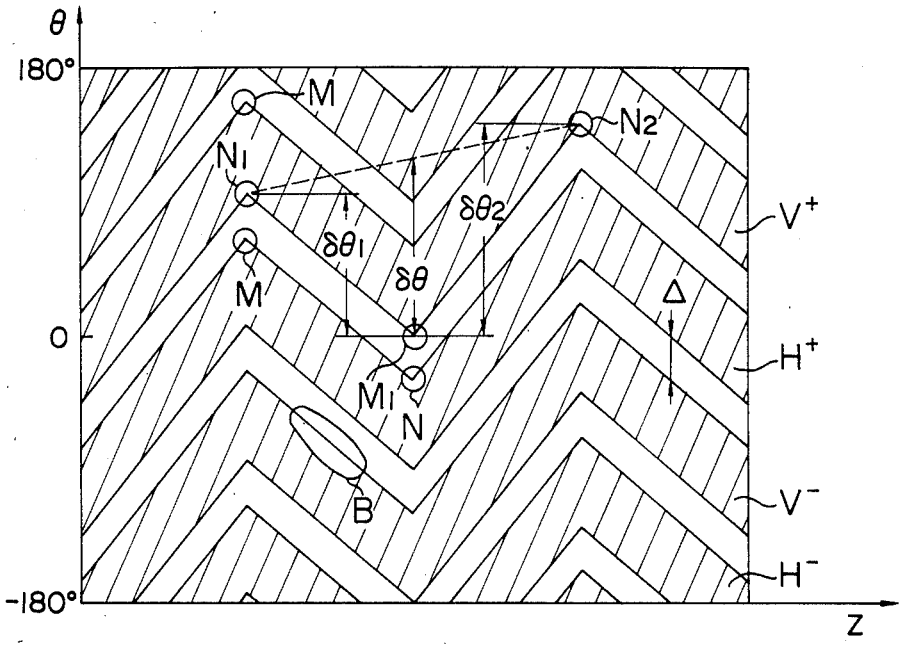
FIG. 4 is a develped view showing two pitches of the straight arrow pattern yoke according to an exemplary embodiment of the present invention.

FIG. 4 shows in a developed view a portion of the pattern yokes according to an exemplary embodiment of the invention which corresponds to two pitches. The pattern yoke is constituted by straight line segments arrayed continuously in a zigzag and interleaved configuration and is referred to as the straight arrow pattern yoke. The deflection electrodes of which the straight arrow pattern yoke consists are arranged such that the space between the adjacent electrodes is the same at both the upper apex M and the location B and that the angle of each apex of the electrode is increased as compared with the hitherto known curved pattern yoke. Consequently, electric discharge is difficult to occur in the vicinity of the upper apex M compared with the previously described case of the curved arrow pattern yoke, to an advantageous effect.

When the straight arrow pattern yoke is twisted at an angle $\omega$ (twist angle), an average value of the angles which the line segments extending between the upper apices and the lower apices form with reference to the axis of the image pickup tube, i.e. the zigzag angle, constitutes a parameter important in view of the characteristics of the image pickup tube. The zigzag angle is given by $\delta\theta=(\delta\theta_1+\delta\theta_2)/2$, where $\delta\theta_1$ represents the angle $<N_1OM_1$ which is formed by the lower apex $N_1$ and the upper apex $M_1$ with reference to the longitudinal axis of the image pickup tube (hereinafter referred to as the tube axis), and $\delta\theta_2$ represents the angle $<N_2OM_1$ formed by the lower apex $N_2$ and the upper apex $M_1$ relative to the tube axis.

In the following, the relationship between the twist angle $\omega$ and the zigzag angle $\delta\theta$ in the straight arrow pattern yoke will be described in detail.

According to an analytical evaluation precedure of the hitherto known curved arrow pattern yoke, electron beam characteristics are determined on the basis of the deflecting electric field uniformly rotating about the tube axis, instead of the effect due to the twist of the pattern yoke (see for example IEEE transaction on electron devices, ED-20 No. 11 p. 163 (1967), by Ritz). However, this procedure is a sort of approximated analysis which cannot be adopted for analytically determining the effect of the zigzag angle $\delta\theta$ in the straight arrow pattern yoke.

Under the circumstances, the electric field generated by the straight arrow pattern yoke was determined by resorting to a method of separation of variables to perform the analysis of electron trajectories, whereby the raster distortion and spread of the electron beam due to the deflection aberrations were analyzed.

Figure 5:
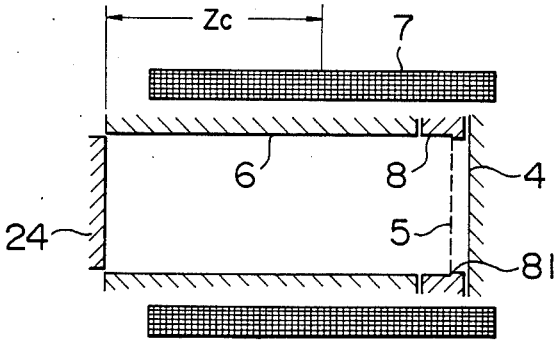
FIG. 5 is a sectional view of a deflecting and focusing system employed for analytical evaluation of characteristics of an image pickup tube.

FIG. 5 shows a model of focusing and deflecting system of an image pickup tube employed in the analysis. Referring to the figure, distance from the beam disc 24 to the mesh electrode is 40 mm, the inner diameter of the pattern yoke is 16 mm, the length of the pattern yoke is 36.2 mm, the repetition number n of the pattern yoke is 8, and the gap $\Delta$ extending between the deflection electrodes in the circumferential direction is 10°. Further, the focusing coil is constituted by a solenoid coil having an inner diameter of 23 mm, an outer diameter of 29.5 mm and length of 40 mm. The current is caused to flow in such a direction that the magnetic field is directed toward the target 4 from the beam disc 24 within the tube. A voltage $E_{C2}$ of 300 V is applied to the beam disc disposed on the exist side of the second grid 23, while a bias voltage $E_{C3}$ of 300 V is applied to the pattern yokes 6. The surface voltage of the target 4 is 5 V. The cylindrical electrode 81 protruding from the mesh electrode 5 toward the target 4 has an inner diameter of 15.8 mm. The distance between the mesh electrode 5 and the target 4 is 1.8 mm. The potential applied across the mesh electrode 5 and the target 4 is determined through numerical calculation by a method of finite differences in accordance with Laplace's equation for axially symmetric field.

Figure 6:
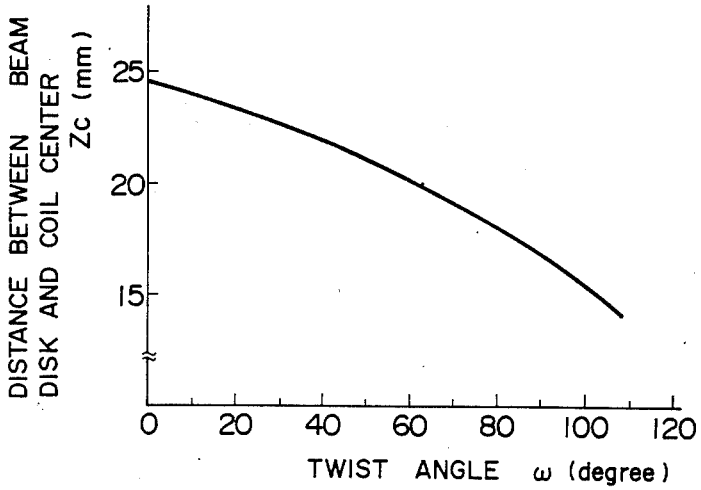
FIGS. 6 and 7 are views for graphically illustrating the conditions under which the landing error can be made zero.
Figure 7:
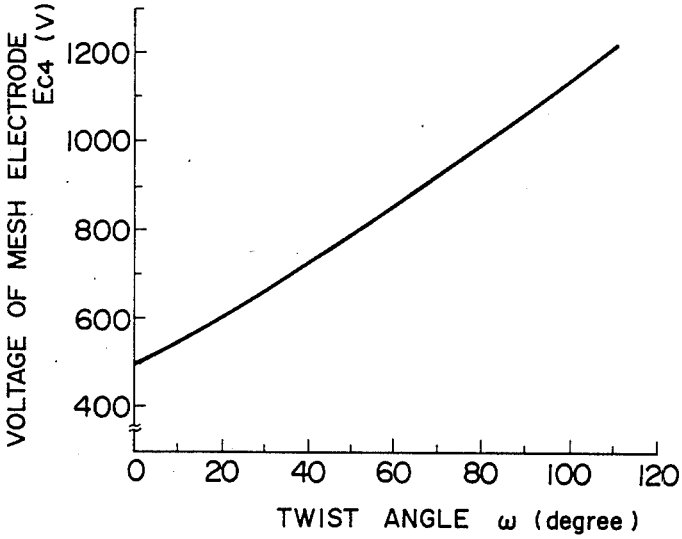

In the first place, the electron trajectory bearing a divergent angle of 1° from the counter of the beam disc 24 is analyzed, and the current flowing through the focusing coil 7 is so adjusted that the r-coordinate of an electron on the target is zero when undeflected. Subsequently, under these conditions, electron emitted from the center of the beam disc 24 in the direction perpendicular thereto is deflected toward the corners, to determine the landing error, i.e. the angle (deviation from the normal) of incidence of electron to the target 4. When the landing error is increased, the picture signal obtained from the image pickup tube is degraded gradually from the center of the image toward the periphery or corners thereof, giving rise to a so-called shading which deteriorates the image quality. Accordingly, it is desirable to operate the image pickup tube under the conditions in which the landing error is made as small as possible. For a given twist angle $\omega$, the landing error was calculated by varying the coil center position $Z_C$ (i.e. the distance between the beam disc 24 and the center of the coil 7) and the voltage $E_{C4}$ applied to the mesh electrode, to thereby determine the conditions which allow the landing error to be reduced to zero. It has been found that the conditions scarcely depend on the zigzag angle $\delta\theta$. FIGS. 6 and 7 graphically illustrate, respectively, the conditions imposed on the factors $Z_C$ and $E_{C4}$ for making the landing error zero for given twist angles. It should be mentioned that determination of raster distortion and spread of the electron beams due to the deflection aberrations for the twist angle $\omega$ and the zigzag angle $\delta\theta$, as mentioned below, are performed through calculation under the conditions illustrated in FIGS. 6 and 7.

Figure 8A:
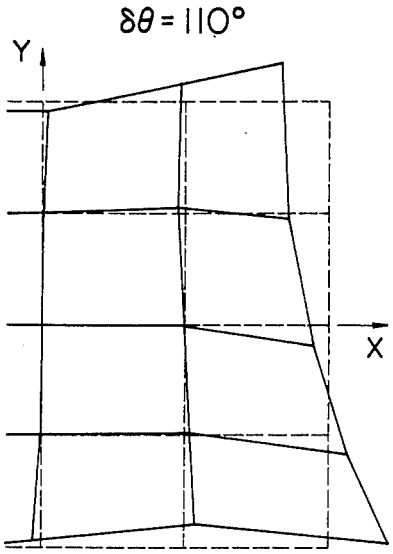
FIGS. 8A, 8B and 8C are views for illustrating raster distortions brought about in the straight arrow pattern yoke.
Figure 8B:
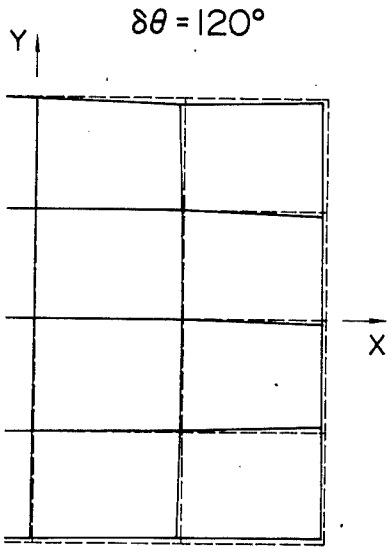
Figure 8C:
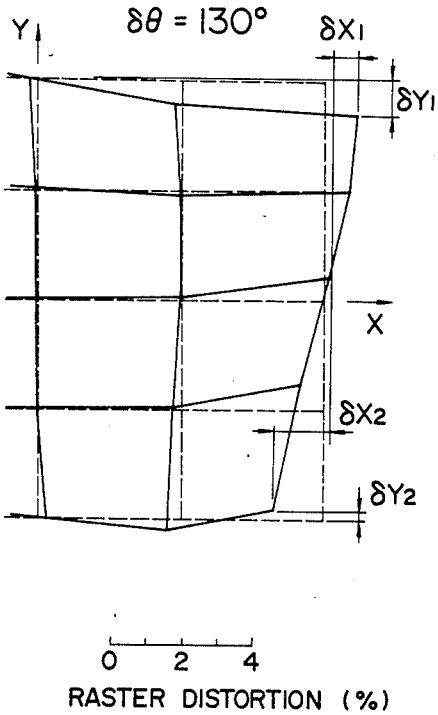

FIGS. 8A, 8B and 8C illustrate the results of analyses of raster distortion performed at various zigzag angles of 110°, 120° and 130°, respectively, for the twist angle $\omega$ of 45°. Since the raster distortion is rotationally symmetric over 180° with reference to the tube axis O, only the first and fourth quadrants of the X-Y coordinate system are illustrated, wherein X represents the horizontal direction with Y representing the vertical direction. For having a better understanding, the raster distortion as illustrated is magnified about ten times. Deviation from the ideal rectangular scanning area (indicated by broken lines) represents the raster distortion.

As will be seen in these figures, variation in the raster distortion amounts to about 2% (normalized by the height of the scanning area) for variation in the zigzag angle of only 10°, indicating that the setting of the zigzag angle $\delta\theta$ is very important. Further, it has been found that such a zigzag angle exists at which the image distortion can be extremely reduced, as illustrated in FIG. 8B.

Figure 9:
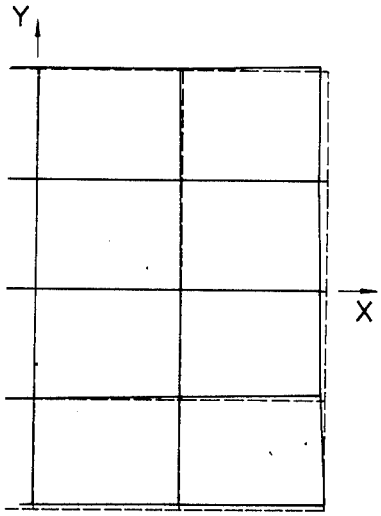
FIG. 9 PRIOR ART
FIG. 9 is a view for illustrating raster distortions appearing in the curved arrow pattern yoke.

FIG. 9 graphically illustrates the results obtained from the analysis of the raster distortion in the hitherto known curved arrow pattern yoke. As will be seen, the raster distortion illustrated in FIG. 8B is equivalent to that illustrated in FIG. 9. In other words, it has been found that so long as the zigzag angle $\delta\theta$ is optimized, the raster distortion making appearance in the case of the twisted straight arrow pattern yoke can be made to be equivalent to the raster distortion appearing in the case of the curved arrow pattern yoke.

Figure 10A:
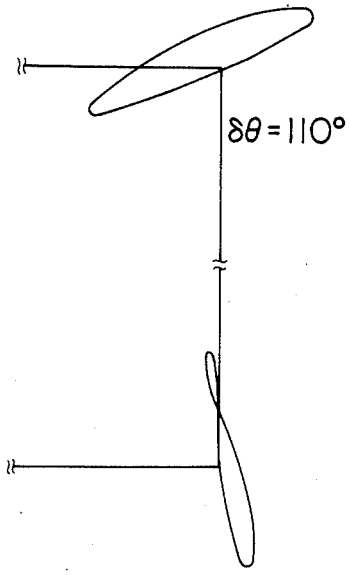
FIGS. 10A, 10B and 10C are views for illustrating spread of electron beam due to deflection aberrations making appearance when the straight arrow pattern yokes are employed.
Figure 10B:
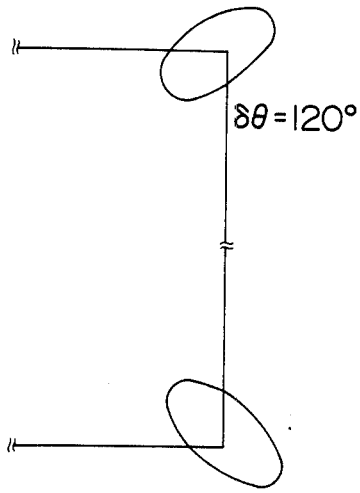
Figure 10C:
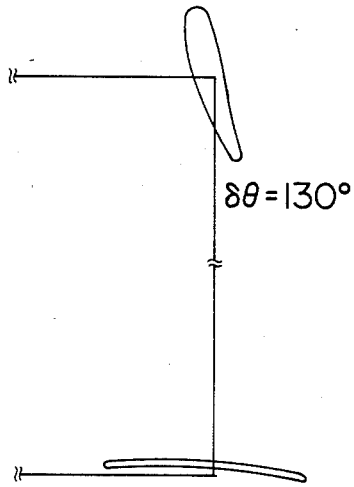

FIGS. 10A, 10B and 10C graphically illustrate how the electron beam behaves under the influence of deflection aberrations in the corner of the scanning area at different zigzag angles of 110°, 120° and 130° for the twist angle $\omega$ of 45°. Since the results are also rotationally symmetric over 180° with reference to the tube axis O, only the first and fourth quadrants of the X-Y coordinate system are shown. Points on the target surface at which a group of electrons emitted from the beam disc at a divergent angle of 1° reached are interconnected to be shown in the form of a spot. It will be seen in the figure that spread of the deflected electron beam greatly depends on the zigzag angle $\delta\theta$ and that there exists a value of the zigzag angle $\delta\theta$ at which the spread of the electron beam can be minimized. Further, by comparing the results illustrated in FIGS. 8 with that of FIG. 10, it will be understood that the beam spread can be made small under the same conditions of $\delta\theta$ under which the raster distortion can be reduced.

Figure 11:
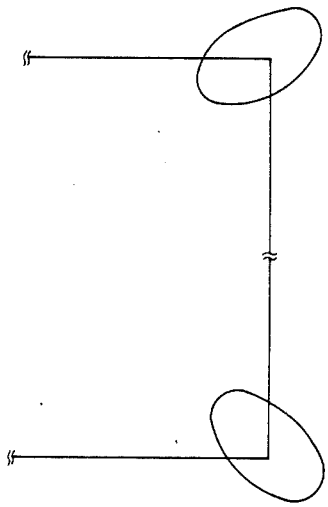
FIG. 11 PRIOR ART
FIG. 11 is a view for illustrating spread of electron beam due to deflection aberrations appearing when the curved arrow pattern yokes are employed.
Figure 11:
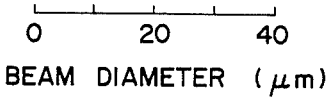
FIG. 11 PRIOR ART

FIG. 11 graphically illustrates the results obtained from the analysis of the beam spread due to the deflection aberrations in the case where the hitherto known curved arrow pattern yoke is employed. From the comparison of the result illustrated in FIG. 10B with that of FIG. 11, it will be seen that spread of the deflected electron beam taking place in the twisted straight arrow pattern yoke can be made equivalent to the one encountered in the curved arrow pattern yoke, only by optimizing the zigzag angle $\delta\theta$.

As will now be appreciated from the foregoing description, the deflection characteristic at least equivalent to that of the curved arrow pattern yoke can be realized even when the twisted straight arrow pattern yoke is employed.

Figure 12:
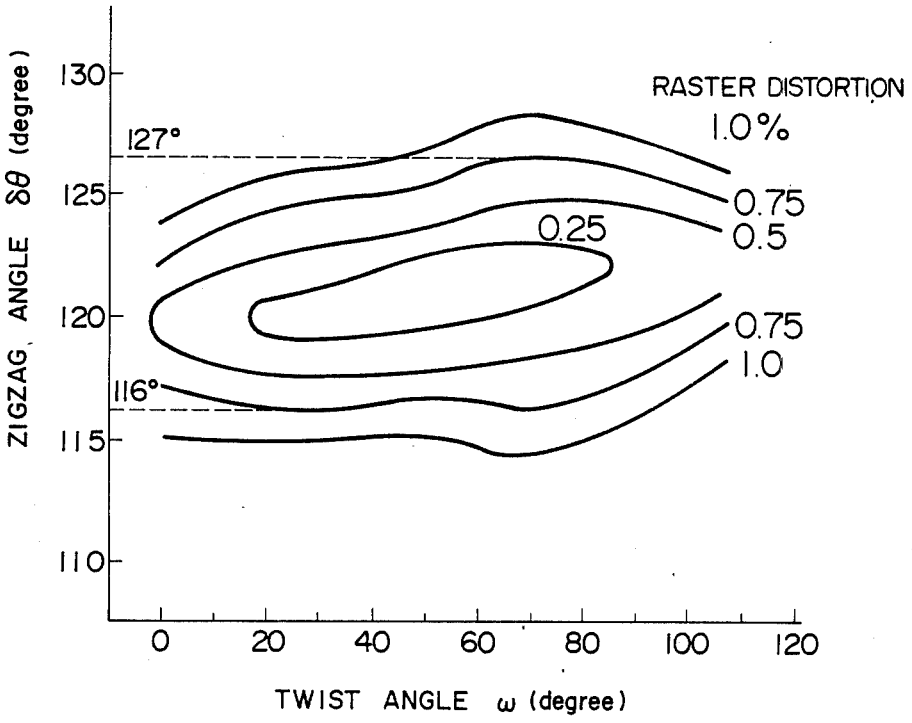
FIG. 12 is a view for illustrating amount of the raster distortion with reference to the zigzag angle and the twist angle.

FIG. 12 illustrates dependence of the raster distortion on the twist angle $\omega$ and the zigzag angle $\delta\theta$ with lines of equal distortion. The image distortion in concern corresponds to the greatest absolute value among the distortions $\delta X_1$, $\delta Y_1$, $\delta X_2$ and $\delta Y_2$ shown in FIG. 8C, the value normalized by the height (6.6 mm) of the scanning area. It is desirable that the raster distortion in the image pickup tube be smaller than about 1.0% or so. In view of the fact that the raster distortion increases due to tolerance in the manufacture, it is desirable that the design raster distortion be smaller than ca. 0.75%. Accordingly, it will be seen from FIG. 12 that the range of the zigzag angle $\delta\theta$ which allows the raster distortion to be reduced sufficiently small for practical application is given by $116° < \delta\theta < 127°$.

Figure 13:
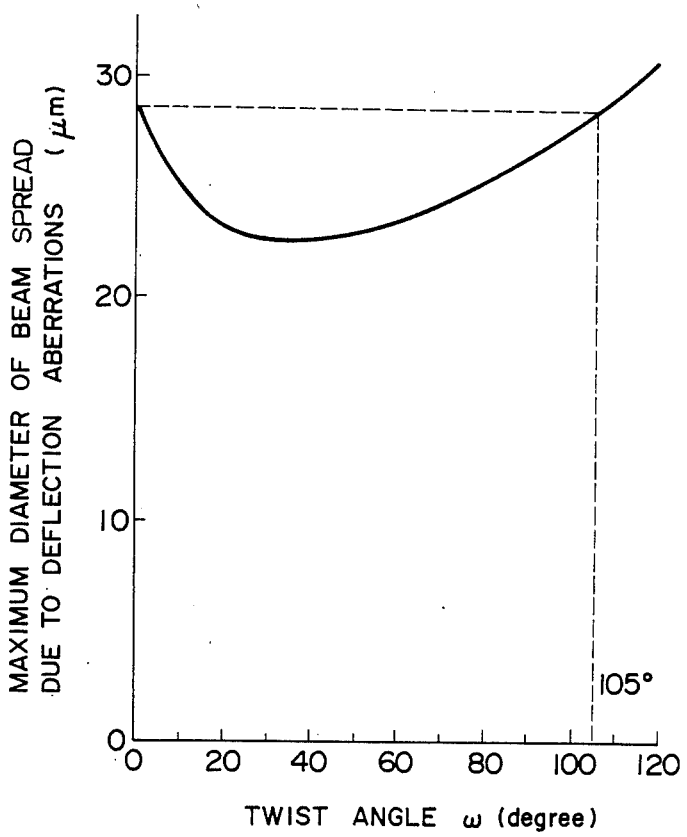
FIG. 13 is a view for illustrating spread of electron beam due to deflection aberrations with reference to the twist angle of the straight arrow pattern yoke.

FIG. 13 shows the spread (maximum diameter) of the electron beam due to the deflection aberrations for the zigzag angle at which the image distortion is minimized for given twist angles. It is desirable that the spread in concern is smaller than the case where the pattern yoke is not twisted (i.e. $\omega = 0°$). Accordingly, the range of the twist angle $\omega$ desirable for realizing the uniformity of resolution is given by $0° < \omega < 105°$.

Figure 14:
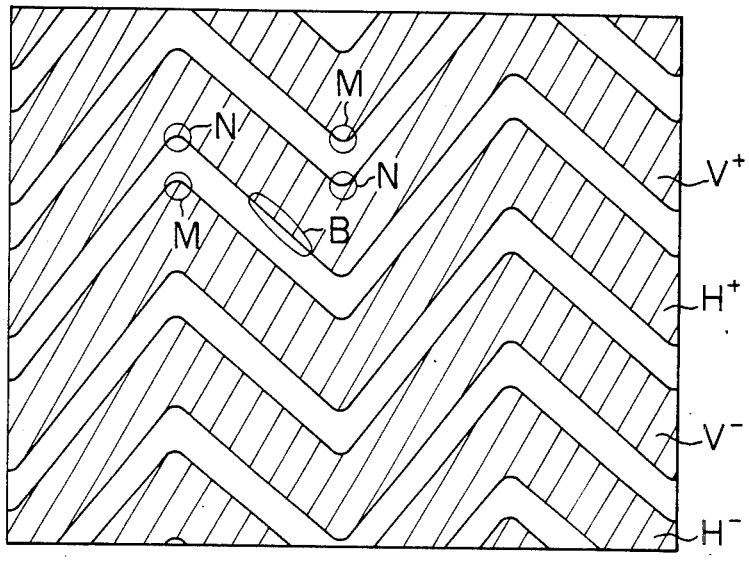
FIGS. 14 and 15 are developed views of straight arrow pattern yokes according to further embodiments of the invention, respectively.
Figure 15:
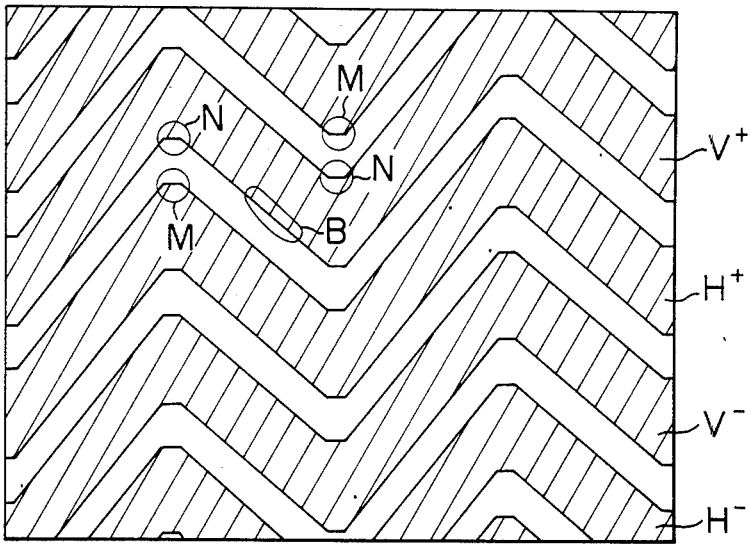

FIGS. 14 and 15 show further embodiment of the invention, respectively. In the case of the embodiment shown in FIG. 14, the upper apices M and the lower apices N of the straight arrow pattern yoke shown in FIG. 4 are slightly rounded. On the other hand, in the case of the straight arrow pattern yoke shown in FIG. 15, the upper and lower apices are cut by straight lines. These minor modifications are made for suppressing further the discharge occurring at the apices and do not exert any appreciable influence to the deflecting electric field within the image pickup tube. Accordingly, the optimal values of the straight line segment forming the line B between the upper and lower apices and the zigzag angle formed by the extensions of the above line segments are the same as those of the yoke shown in FIG. 4.

We claim:

1. An image pickup tube comprising:

an electron gun disposed within the tube at one end thereof for producing an electron beam;

a target disposed within the tube at the other end thereof and scanned with said electron beam;

a focusing coil disposed around the tube for generating a magnetic field to focus said electron beam; and a plurality of deflection electrodes disposed on the inner surface of the tube between said electron gun and said target for deflecting said electron beam, wherein each of said deflection electrodes is configured so that when developed to a plane a plurality of electrode portions each of a substantially linear form are arrayed in a zigzag pattern having upper apices and lower apices alternately, said upper apices and said lower apices included in each of said deflecting electrodes are positioned on a helix revolving about the axis of said tube at a predetermined angle, one end (A) and the other end (B) of said helix form with the axis (O) of said tube a twist ($<ABO$) angle which is not greater than 105°, and an average value of angles ($<MON_1$ and $<MON_2$) formed respectively by each upper apex and two lower apices ($N_1$, $N_2$) located adjacent to said upper apex (M) with reference to the axis (O) of the tube is in a range of 116° to 127°.

2. An image pickup tube according to claim 1, wherein said deflection electrode is formed of completely straight line segments when developed to a plane.

3. An image pickup tube according to claim 1, wherein the upper apices and the lower apices of said deflection electrodes are rounded.

4. An image pickup tube according to claim 1, wherein the upper apices and the lower apices of said deflection electrodes are cut by straight lines.

5. A cylindrical image pickup tube comrising:

an electron gun disposed within the cylindrical tube at one end thereof for producing an electron beam;

a target disposed within the cylindrical tube at the other end thereof for producing an electron beam;

a focusing coil disposed around the cylindrical tube for generating a magnetic field to focus said electron beam; and a plurality of electrostatic deflection electrodes disposed on the inner surface of the cylindrical tube between said electron gun and said target for deflecting said electron beam, wherein each of said deflection electrodes includes a plurality of electrode portions arrayed in a zigzag type pattern of repeating and alternating upper apices and lower apices formed by a plurality of segments, each segment interconnecting said upper and lower apices having a substantially straight line shape when said pattern is formed on a two dimensional plane, and wherein said upper apices and said lower apices corresponding to each of said deflecting electrodes are positioned on a helically shaped line of sight on the inner surface of said cylindrical tube revolving about the longitudinal axis of said cylindrical tube, from one end of said cylindrical tube, adjacent said electron gun, to the other end, adjacent said target, and at a predetermined angle, one end (A) and the other end (B) of said helix form with the longitudinal axis (O) of said tube a twist angle ($<AOB$) which is not greater than 105°, and an additional angle corresponding to an average value of angles ($<MON_1$ and $<MON_2$) formed respectively by each upper apex and two lower apices ($N_1$, $N_2$) located adjacent to said upper apex (M) with reference to the cylindrical axis (O) of the tube and having a range of 116° to 127°.

6. An image pickup tube according to claim 5, wherein the upper apices and the lower apices of said deflection electrodes are rounded.

7. An image pickup tube according to claim 5, wherein the upper apices and the lower apices of said deflection electrodes are cut by straight lines.

8. A cylindrical image pickup tube according to claim 5, wherein said zigzag type pattern comprises four electrostatic deflection electrodes.

9. A cylindrical image pickup tube comprising:

an electron gun, having a beam disc with a limiting aperature formed therein, disposed within the cylindrical tube at one end thereof for producing an electron beam through said limiting aperture;

a target disposed within the cylindrical tube at the other end thereof and scanned with said electron beam;

a focusing coil disposed around the cylindrical tube for generating a magnetic field to focus said electron beam; and a plurality of electrostatic deflection electrodes disposed on the inner surface of the cylindrical tube between said electron gun beam disc and said target for deflecting said electron beam, wherein each of said deflection electrodes includes a plurality of electrode portions interleaved in a zigzag type pattern array of repeating and alternating upper apices and lower apices formed by a plurality of segments, each segment interconnecting said upper and lower apices having a substantially straight line shape when said pattern is formed on a two dimensional plane, and wherein said zig-zag type pattern being further characterized by said electrostatic deflection electrodes being twisted about the longitudinal axis of said cylindrical tube from one end, proximate to said beam disc, to the other end, proximate to said target, with a twist angle about the axis of said cylindrical tube not greater than 105° and an additional angle corresponding to an average value of angles formed by each of the upper apex and the two lower apices located adjacent said upper apex with reference to the cylindrical axis of the tube and having a range of 116° to 127°.

10. A cylindrical image pickup tube according to claim 9, wherein said interleaved zigzag type pattern array of said plurality of electrostatic deflection electrodes being disposed such that the upper apices of each of said deflection electrodes are positioned on a helically shaped line of sight between said one end and said other end.

11. An image pickup tube according to claim 9, wherein the upper apices and the lower apices of said deflection electrodes are rounded.

12. An image pickup tube according to claim 9, wherein the upper apices and the lower apices of said deflection electrodes are cut by straight lines.

13. A cylindrical image pickup tube according to claim 9, wherein said zigzag type patter comprises four electrostatic deflection electrodes.

* * * * *